US005666192A

United States Patent [19]

Mashimo et al.

[11] Patent Number: 5,666,192

[45] Date of Patent: Sep. 9, 1997

[54] CHARGING MEMBER AND IMAGE FORMING APPARATUS

[75] Inventors: Seiji Mashimo, Tokyo; Yasushi Sato, Kawasaki; Harumi Ishiyama, Yokohama; Tadashi Furuya, Kawasaki, all of Japan

[73] Assignee: Canon Kabushiki Kaisha, Tokyo, Japan

[21] Appl. No.: 508,900

[22] Filed: Jul. 28, 1995

[30] Foreign Application Priority Data

Jul. 28, 1994 [JP] Japan ..... 6-195929

[51] Int. Cl.[6] ..... G03G 15/02

[52] U.S. Cl. ..... 399/174; 361/225; 427/508; 428/900; 399/267; 399/159

[58] Field of Search ..... 355/219, 211, 355/251; 361/225; 428/694 TP, 694 BC, 900; 427/508; 118/657; 492/18, 53

[56] References Cited

U.S. PATENT DOCUMENTS

| | | | |
|---|---|---|---|
| 4,174,903 | 11/1979 | Snelling | 355/219 |
| 4,202,937 | 5/1980 | Fukuda et al. | 430/58 |
| 5,149,914 | 9/1992 | Koga et al. | 118/657 |
| 5,202,729 | 4/1993 | Miyamoto et al. | 355/251 |
| 5,272,505 | 12/1993 | Shishido et al. | 355/219 |
| 5,426,489 | 6/1995 | Haneda et al. | 355/219 |
| 5,430,526 | 7/1995 | Ohkubo et al. | 355/211 |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A charging member for charging a member to be charged, includes a magnet member and a surface electroconductive layer for supporting electroconductive magnetic particles, the layer being supported by the magnet member and rotating together with the magnet member in a region supporting the magnetic particles.

24 Claims, 7 Drawing Sheets

CHARGING MEMBER AND IMAGE FORMING APPARATUS

FIELD OF THE INVENTION AND RELATED ART

The present invention relates to an image forming apparatus such as a copying machine or a laser beam printer, and a charging member usable with the image forming apparatus.

It is known that a member to be charged such as a photosensitive member is charged by a charging member of a magnetic brush type. When a charging member of a magnetic brush type is used, a magnetic brush of magnetic particles is formed by a magnetic force of a magnet member, and the magnetic brush is contacted to the surface to be charged, and electric energy is supplied to the magnetic brush, thus charging the surface to be charged. With the conventional charging member, the magnetic particles are deposited on the outer peripheral surface of the electrode sleeve to form the magnetic brush, by the magnetic force of the fixed magnet roller in a non-magnetic rotatable electrode sleeve.

However, in order to increase the magnetic confining force for the magnetic particles by the magnet member, it is preferable that the magnetic brush is formed directly on the magnet roller without use of the electrode sleeve.

In this case, however, charging defects may occur, or non-uniform charging due to unevenness of resistance of magnet roller may occur. Therefore, when use is made with the magnet roller for a charging device of an image forming apparatus, an improper image may be formed.

Particularly, when the charge is injected into the photosensitive member by the contact between the magnetic brush and the photosensitive member to charge the photosensitive member, it has been required to flow the current uniformly over the entirety of the contact portion where the magnetic particles are contacted to the photosensitive member.

SUMMARY OF THE INVENTION

Accordingly, it is a principal object of the present invention to provide a charging member and an image forming apparatus for uniformly charging a member to be charged.

It is another object of the present inventory to provide a charging member and an image forming apparatus capable of flowing uniform current to the magnetic particles of the magnetic brush.

It is another object of the present invention to provide a charging member and an image forming apparatus wherein a magnetic confining force for magnetic particles by a magnet member is improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

EMBODIMENT 1 (FIGS. 1–6)

Figure 1:
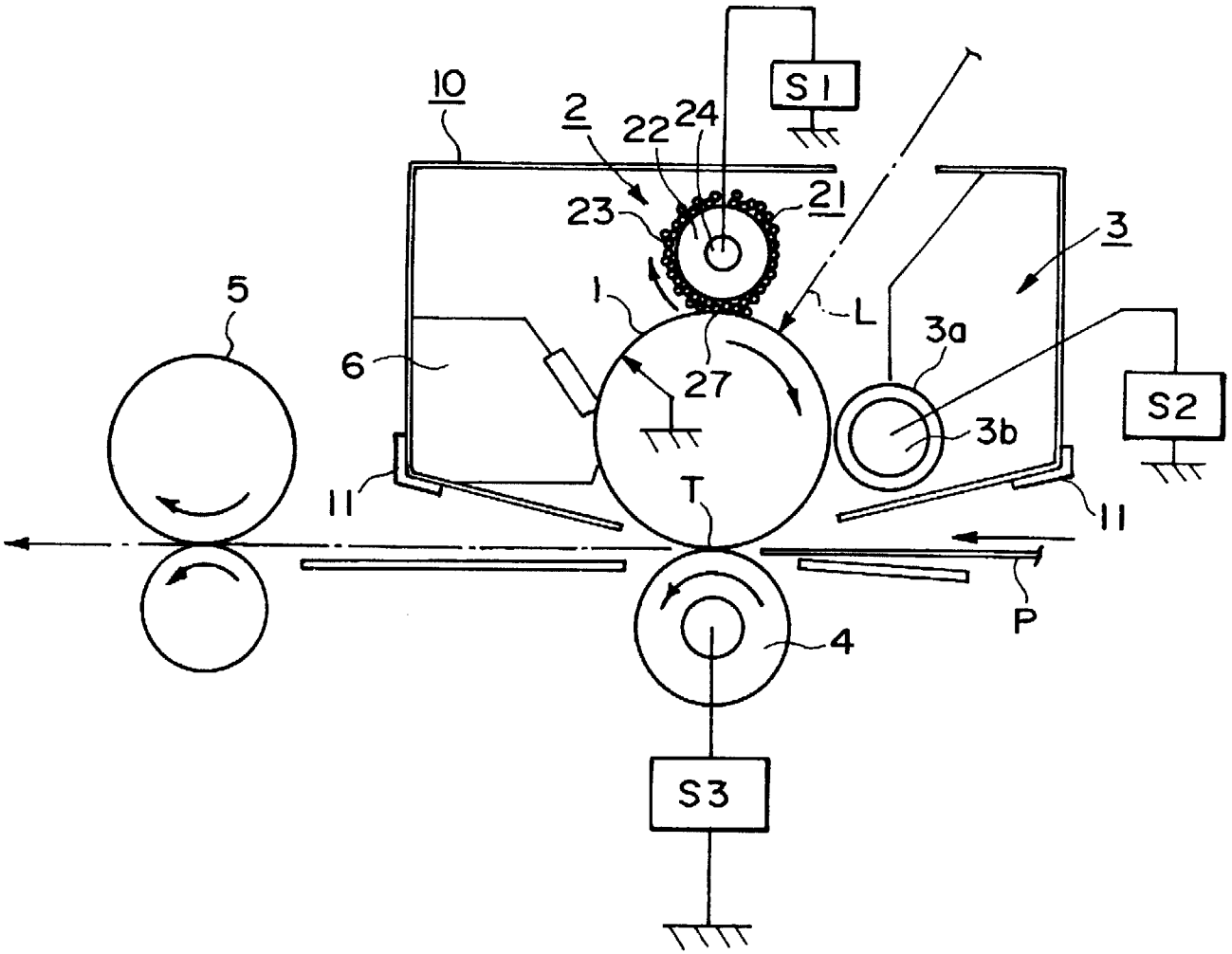
FIG. 1 is a schematic illustration of an example of an image forming apparatus.

(1) Example of Image Forming Apparatus (FIG. 1)

FIG. 1 is a schematic illustration of an example of an image forming apparatus. The image forming apparatus of this embodiment is a laser beam printer using an electrophotographic process.

Designated by 1 is an electrophotographic photosensitive member of rotatable drum type as an image bearing member (member to be charged). In this embodiment, it is an OPC photosensitive member having a diameter of 30 mm, and is rotated in the clockwise direction indicated by an arrow at a process speed (peripheral speed) of 100 mm/sec.

Designated by 2 is a charging device using a contact charging member 21 of magnetic brush type, and this will be described in detail hereinafter. The photosensitive member 1 is uniformly charged to a predetermined polarity (negative) by the charging device 2 while it is rotated.

The charged surface of the rotation photosensitive member 1 is exposed to a laser beam modulated in the intensity in response to time series electrical digital pixel signal of intended image information emitted from a laser beam scanner (not shown) including a laser diode, polygonal mirror or the like, so that an electrostatic latent image is formed on the peripheral surface of the rotating photosensitive member 1, corresponding to the intended image information.

The electrostatic latent image is developed into a toner image by a reverse development device 3 using magnetic one component insulative toner. Designated by 3*a* is a non-magnetic developing sleeve having a diameter of 16 mm containing therein a magnet 3*b*, and the toner (negative) is coated on the developing sleeve 3*a*. The gap from the photosensitive member 1 surface is fixed to 300 microns, and is rotated at the same speed, while 300 microns is applied from a developing bias voltage source S2 to the sleeve 3*a*. The voltage is produced by combining a DC voltage of −500V and a rectangular AC voltage having a frequency of 1800 Hz and a peak-to-peak voltage 1600V to effect jumping development between the sleeve 3*a* and the photosensitive member 1.

On the other hand, a transfer material P as a recording material is supplied from a sheet feeding portion, and is fed at a predetermined timing to a press-contact nip portion (transfer portion) T formed between the rotation photosensitive member 1 and an intermediate resistance transfer roller 4 (contact transfer means). The transfer roller 4 is supplied with a predetermined transfer bias voltage from a transfer bias application voltage source S3. In this embodiment, the roller resistance value is $5\times10^8$ Ohm, and +2000V is applied thereto.

The transfer material P introduced to the transfer portion T is advanced by the transfer nip T, whereby the toner image formed and carried on the surface of the rotating photosensitive member 1 is sequentially transferred to the transfer material by electrostatic force and pressure.

The transfer material P having received the transferred toner image, is separated from the surface of the photosensitive member 1 and is introduced into a fixing device 5, and the toner image is fixed at the transfer portion T, and it is discharged to the outside as a print.

The surface of the photosensitive member after the toner image transfer onto the transfer material P, is cleaned by a cleaning device 6 so that foreign matter such as remaining toner is removed to permit repetitive image forming operation.

The printer of this embodiment is a process cartridge type device wherein 4 process means namely the photosensitive member 1, contact charging member 21, developing device 3 and cleaning device 6, are contained and formed into a cartridge 10, which are detachably mountable to a main assembly. Element 11 functions as a mounting guide and a supporting member for the cartridge. The process cartridge may contain a photosensitive member and at least one of a charging member, a developing device and a cleaning device. However, the image forming apparatus is not limited to the process cartridge mounting-and-demounting type.

(2) Photosensitive Member 1

The photosensitive member 1 used in this embodiment is a negatively chargeable OPC photosensitive member, and comprises an aluminum drum base and 5 function layers thereon.

The first layer is a primer layer on the base, and is an electroconductive layer having a thickness of approx. 20 microns. This is effective to cover defects or the like of the aluminum drum base and to prevent production of moire due to reflection of the laser exposure.

The second layer is a positive charge injection layer, and functions to prevent neutralization of the positive charge injected from the aluminum drum base with the negative charge applied to the photosensitive member surface. It is an intermediate resistance layer having a thickness of approx. 1 micron and a volume resistivity of $10^6$ Ohm.cm approx. adjusted by AMILAN (tradename of polyamide resin material, available from Toray Kabushiki Kaisha, Japan) resin material and methoxymethyl nylon.

The third layer is a charge generating layer, and is a layer having a thickness of approx. 0.3 microns and is produced by dispersing diazo pigment in resin material. It generates couples of positive and negative charge upon application of the laser exposure thereto.

The fourth layer is a charge transfer layer, and it is produced by dispersing hydrazone in polycarbonate resin material. It is a P-type semiconductor. Therefore, the negative charge on the photosensitive member surface is unable to move through this layer, and only the positive charge produced by the charge generating layer can be transferred to the photosensitive member surface.

The fifth layer is a charge injection layer on the surface of the photosensitive member, and is produced by dispersing $SnO_2$ ultra fine particles in light curing acrylic resin material. More particularly, $SnO_2$ particles having a particle size of approx. 0.03 microns having a resistance lowered by doping antimony (70% by weight), is dispersed in resin material. When the charging device is of the magnet roller rotating type, the chains of the magnetic brush are harder than that in the sleeve type, and therefore, 26% of Teflon (Dupont, tradename of PTFE) may be dispersed to improve sliding property to increase mobility of the magnetic particles.

Into the charge injection layer, the charge is injected through the contact portion between the charging member 2 and the charge injection layer.

(3) Charging Device 2

In the charging device 2 of this embodiment, the charging member 21 of magnetic brush type comprises a rotatable magnet roller 22 functioning as a magnet member and a magnetic brush 23 constituted by magnetic particles deposited on the outer surface of the magnet roller 22.

Figure 2:
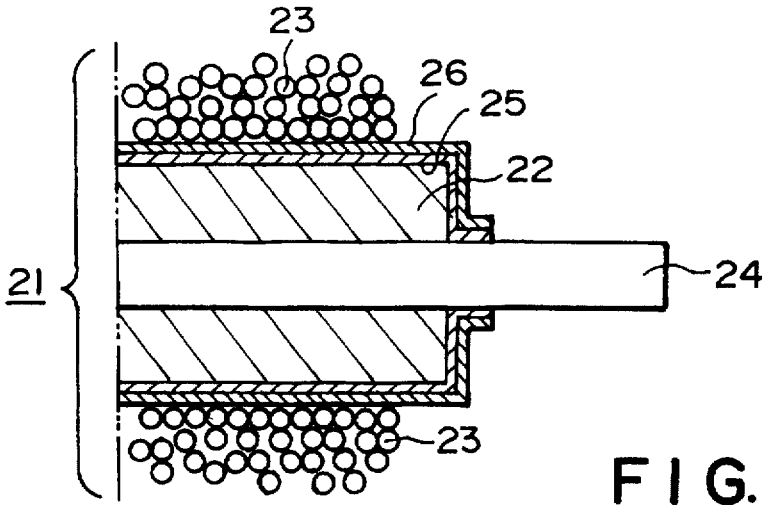
FIG. 2 is a schematic view of a section of an end portion having been treated for electroconductivity by adhering an electroconductive tape (copper tape) on the surface thereof.
Figure 3:
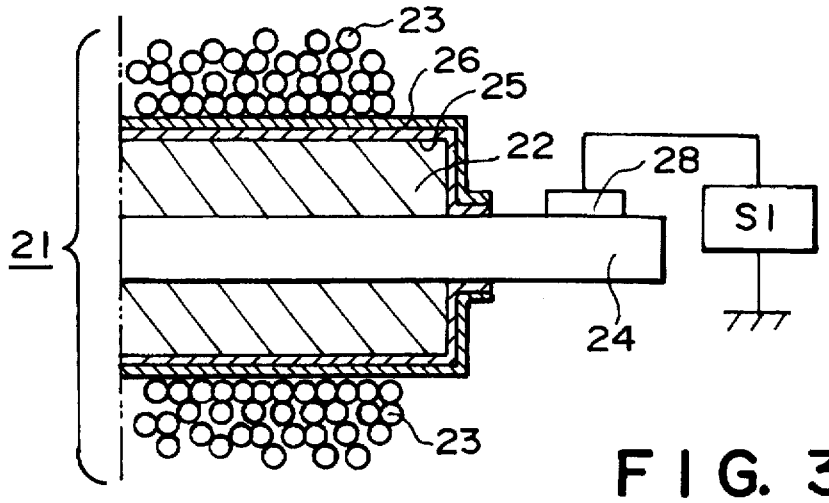
FIG. 3 shows the case in which an electric energy supply plate is contacted to a core metal of magnet roller to supply electric energy to a magnetic brush.

The magnet roller 22 has equal 8 poles, and has an outer diameter of 18 mm and a length of 230 mm. Designated by 24 is an electroconductive core metal of the magnet roller 22. The outer peripheral surface of the magnet roller 22 is covered by an adhered electroconductive tape having a thickness of 50 microns, in this embodiment, a copper tape 26 having a thickness of 50 microns, so that the magnetic brush deposition surface is made electrically conductive, as shown in FIG. 2.

Figure 5:
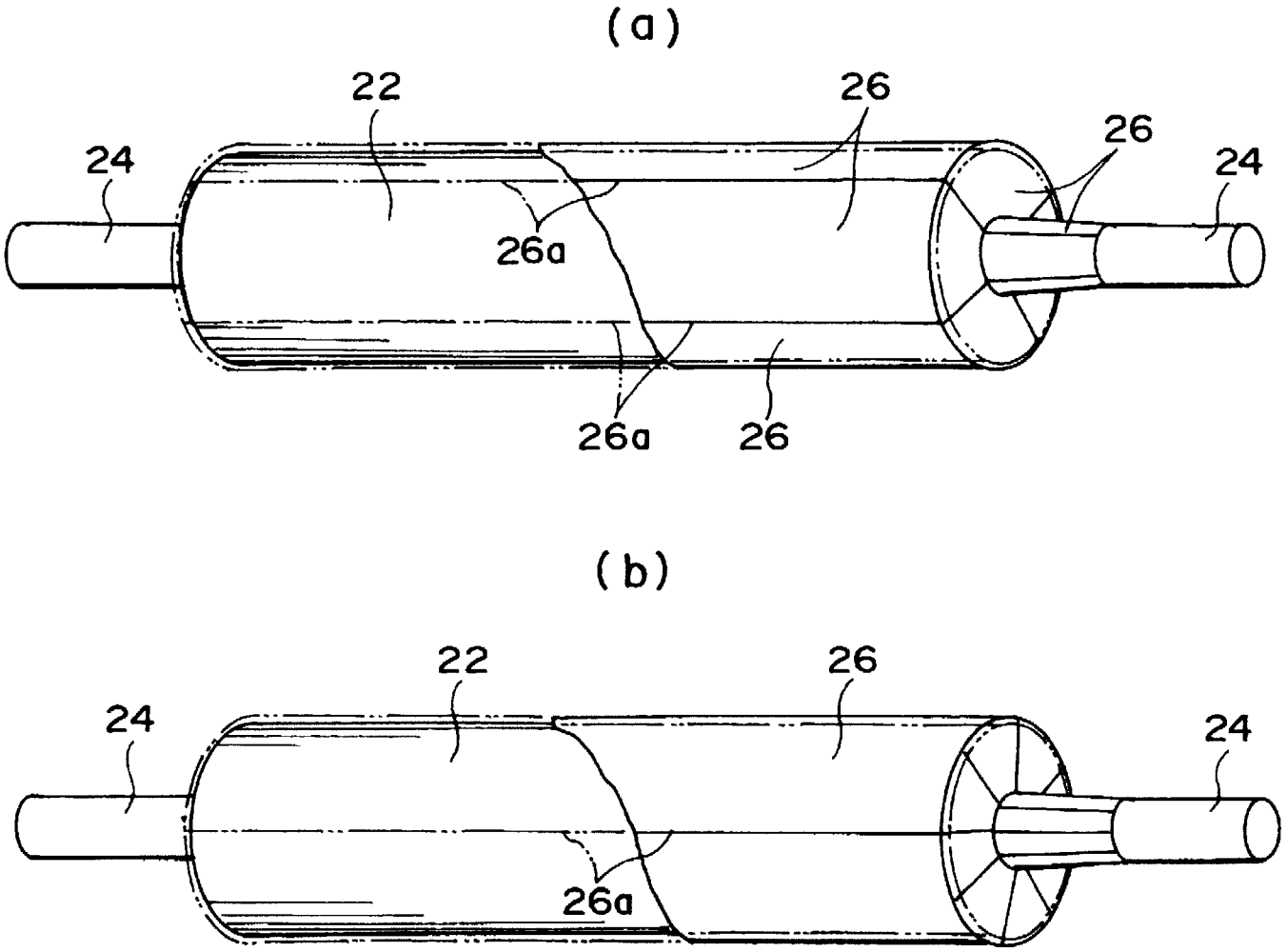
FIG. 5(*a*) shows an electroconductive tape coating on the magnet roller surface, and (*b*) shows another method (roll-up type).

In this embodiment, as shown in FIG. 5, (a), four copper tapes 26 each having a width of approx. ¼ of the circumferential length of the magnet roller 22 are bonded on the outer surface of the magnet roller 22 in parallel to cover the entirety of the outer peripheral surface of the roller 22. Each of the ends of the copper tape 26 is extended and is bonded to cover approx. one half of the end surface and the outer surface of the roller 22.

Figure 6:
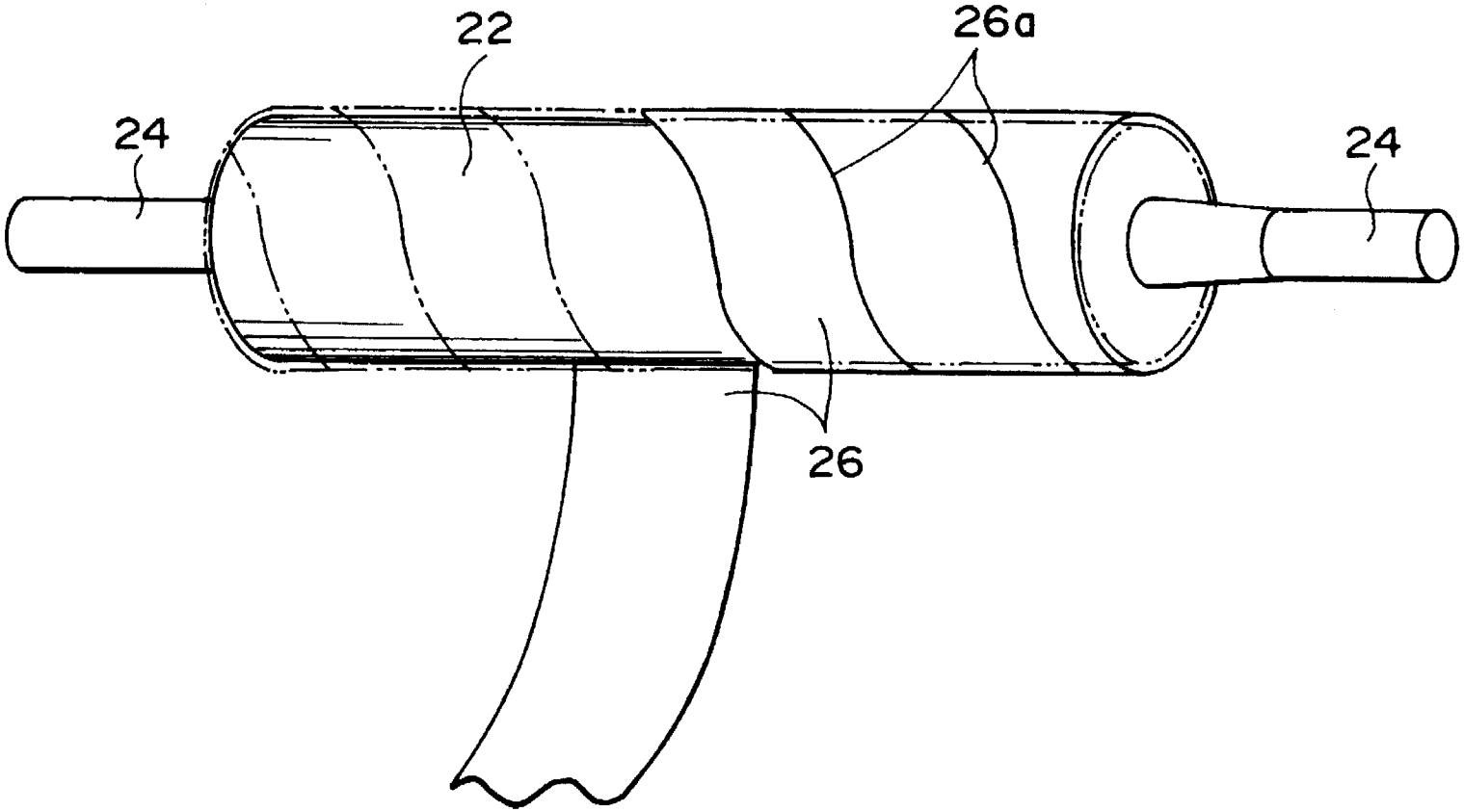
FIG. 6 shows a further method (spiral type).

The method of covering the magnet roller 22 with the copper tape 26 is not limited to this. For example, use may be made with one wide copper tape 26 having a width substantially equal to the circumferential length of the the magnet roller 22, as shown in FIG. 5, (*b*), and the outer peripheral surface of the roller is wrapped by rolling up the tape and bonding it. This is preferable since only one seam line 26*a* of the copper tape 26 in the roller generating line direction is produced as contrasted to 4 seams in the case of FIG. 5(*a*). The copper tape 26 may be wrapped and bonded in a spiral form on the outer peripheral surface of the roller 22, as shown in FIG. 6.

The core metals 24 and 24 of the magnet roller 22 at the opposite ends are rotatably supported by an unshown bearing, and the roller is disposed close to the photosensitive member 1 in parallel with the photosensitive member 1 with a predetermined gap therebetween. It is rotated by an unshown driving system.

The magnetic particles are deposited on the outer peripheral surface of the magnet roller 22 to form a magnetic brush 23 of the magnetic particles, and the magnetic brush 23 is contacted to the surface of the photosensitive member 1 to form a charging nip portion 27 (FIG. 1).

The magnetic particles used in this embodiment is ferrite magnetic particles having an intermediate resistance and having an average particle size of 30 microns, a maximum magnetization 60 $Am^2/Kg$, and density of 2.2 $g/cm^2$. The gap between the magnet roller 22 coated with the copper tape 26 and the photosensitive member 1 surface are maintained at approx. 500 microns by mounting spacer roller (unshown) to each of the ends of the magnet roller 22 and contacting them to the photosensitive member 1 surface. When the amount of the magnetic particles on the magnet roller 22 is 20 g, the width at the charging nip portion 27 in the entirety including the stagnation of the magnetic particles is approx. 5 mm. The resistance of the magnetic particles with this width of the charging nip was measured as $5\times10^6$ Ohm when DC 100v was applied.

As regards the number of the poles of the magnet roller 22, if it is less than 4, the difference of the magnetic confining force for the magnetic particles between adjacent poles is too large with the result of higher tendancy of magnetic particle deposition or the like to the photosensitive member between them. If the number is too large, the degree of the leakage of the magnetic field decreases with the result of reduction of the layer thickness of the magnetic brush, the charging nip portion 27 is not easily formed. As a result, the charging property is deteriorated. For these reasons, the number of the magnetic poles is preferably 4–40, with equal arrangement. The magnetic flux density at the magnetic pole position on the magnet roller surface was 0.1T (tesla). The magnetic flux density is preferably not less than 0.03T in consideration of the magnetic confining force to the magnetic particles.

In this embodiment, the bonding layer of adhesive material layer 25 of the copper tape 26 to the magnet roller is used as an electroconductive adhesive material layer. Therefore, the electric energy can be supplied to the copper tape coating layer 26 as the electroconductive layer on the outer peripheral surface of the magnet roller which is the magnetic brush deposition surface of the magnet roller 22 by contacting an electric energy supply plate 28 to the core metal 24 of the magnet roller 22.

Figure 4:
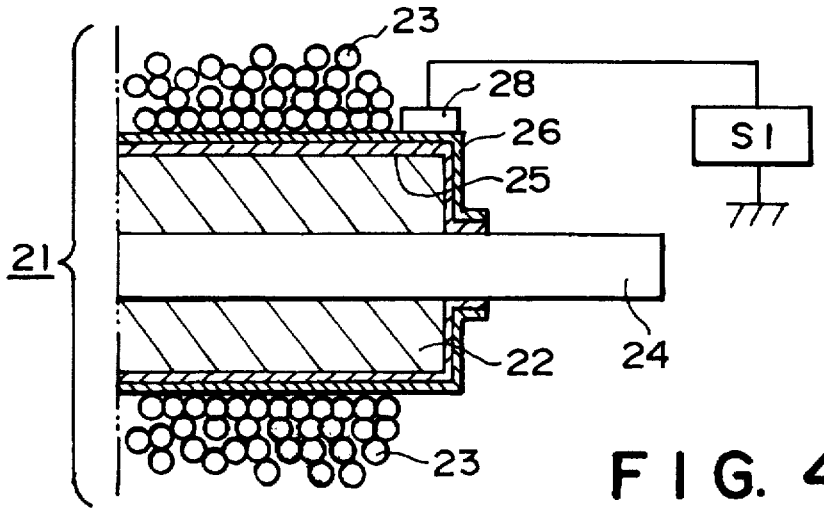
FIG. 4 shows the case in which an electric energy supply plate is contacted to a surface electroconductive layer of the magnet roller to supply electric energy to the magnetic brush.

When the use is made with an insulative adhesive material layer, the electric energy can be supplied by contacting the electric energy supply plate 28 to the copper tape 26 surface, as shown in FIG. 4.

Here, the peripheral speed ratio between the peripheral speed of the magnetic brush 23 by the rotation of the magnet roller 22 and the peripheral speed of the photosensitive member 1 (drum) is defined as follows:

Peripheral speed ratio (%)=(magnetic brush peripheral speed–drum peripheral speed)/drum peripheral speed(×100.

The peripheral speed of the magnetic brush 23 is negative when the direction thereof is opposite from that of the photosensitive member 1. When the chances of contact between the magnetic brush 23 and the photosensitive member 1 is considered, the absolute value of the peripheral speed ratio is preferably not less than 100%. But, −100% means that the brush is at rest. In this case, the charging defect occurs where the brush 23 is not sufficiently contacted to the photosensitive member 1 surface. If this occurs, the shape of the resting portion appears, as it is, on the image. The rotation in the codirectional direction, if the same peripheral speed ratio as in the case of the opposite direction is to be provided, results in higher rotational frequency of the magnetic brush 23. Then, disadvantages arise in terms of scattering or the like of the magnetic particles. In this embodiment, the peripheral speed ratio is −300%.

When a DC charging bias of −700V from the charging bias application voltage source S1 to the magnetic brush 23 by supplying electric energy to the copper tape coating layer 26 as the electroconductive layer which is magnetic brush deposition surface, the outer peripheral surface of the photosensitive member 1 is uniformly charged to substantially −700V.

If the electric energy is directly supplied to the magnet roller having a high resistance, the charging defect arises, or the resistance non-uniformity of the configuration appears in the image, which is a problem. However, by using the structure of this embodiment, the photosensitive member 1 surface can be uniformly charged, so that satisfactory images can be provided.

Additionally, the magnetic confining force of the magnetic particles forming the magnetic brush 23 is stronger than in the case that the magnetic particles are deposited on the sleeve having a magnet therein.

Particularly, in the case of charge injection charging type, the magnetic particles are contacted to the photosensitive member to inject the charge. The charging defect attributable to the reduction of the magnetic particles can be prevented.

EMBODIMENT 2 (FIG. 7)

Figure 7:
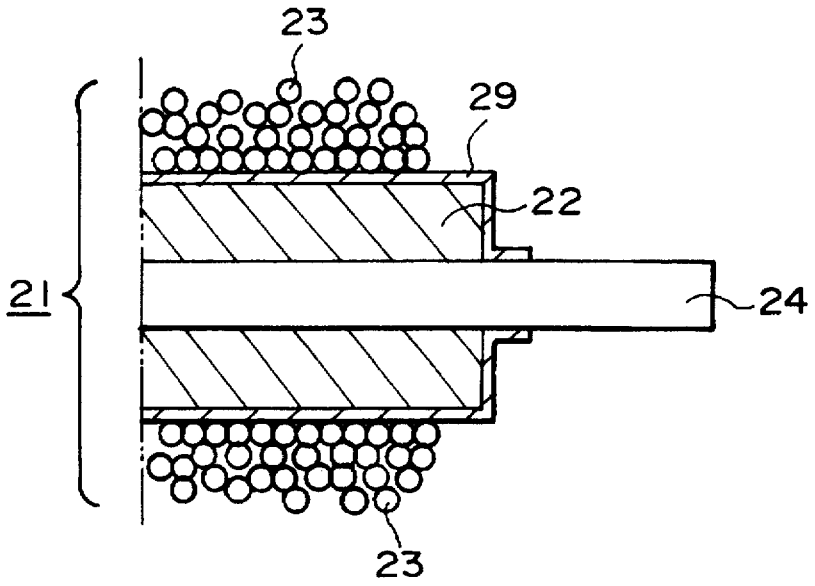
FIG. 7 is a schematic view of a section of an end portion side of a magnet roller having a surface treated for electroconductivity by coating thermosetting electroconductive paint (second embodiment).

FIG. 7 shows another embodiment of the charging member.

In this embodiment, the surface of the magnet roller 22 is coated with conductive material 29, by which the surface of the magnet roller 22 is made conductive. More particularly, as to the electroconductive paint (electroconductive coating material). The use is made with urethane resin material (thermosetting material) in which 80% by weight of carbon black is dispersed as the electroconductive material. The paint thereof is painted by dip coating over the entire area of the magnet roller 22 surface to cure it by heat for 15 minute at 70° C. to form a painted layer 29 having a thickness of approx. 30 microns as the conductive coating. The resistance value of the coating layer 29 was approx. $3\times10^2$ Ohm.

Usable examples of the binder resin material for the electroconductive coating 29 include the urethane resin material, acrylic resin material, phenolic resin, melamine epoxy resin material, urea resin material, alkyd resin material, or the like. As for the dispersion conductive material, usables include the carbon black, ITO ($In_2O_3$ doped with Sn), $TiO_2$ or another metal oxide.

As for another coating method, roller coating, spray coating or the like is usable. The thickness of the electroconductive paint is preferably small, since the magnetic confining force is stronger with decrease of the distance between the magnetic particles and the magnet roller surface. More particularly, it is preferably not more than 3 mm. As for the resistance value of the magnet roller surface after the coating, when low resistance value of the paint is high, the voltage drop occurs corresponding to the divided voltage applied to the paint with the result that the photosensitive member surface is not charged up to the intended potential with the result of voltage drop, the resistance value is preferably not more than $10^3$ Ohm.

By the use of this structure, the surface can be made conductive while maintaining the smoothness of the magnet roller surface.

In the first embodiment, as shown in FIGS. 5 and 6, the seam line 26*a* occurs due to the bonded copper tape 26 with the result of charging defect along this line. So, the peripheral speed ratio is not reduced. However, if the electroconductive paint is uniformly applied on the magnet roller 22 surface as in this embodiment, the seam line 26a does not occur, magnet roller can be stably supplied with electric energy even if the peripheral speed ratio is reduced to −150%, and the stabilized charging is accomplished for a long term.

EMBODIMENT 3 (FIG. 8)

Figure 8:
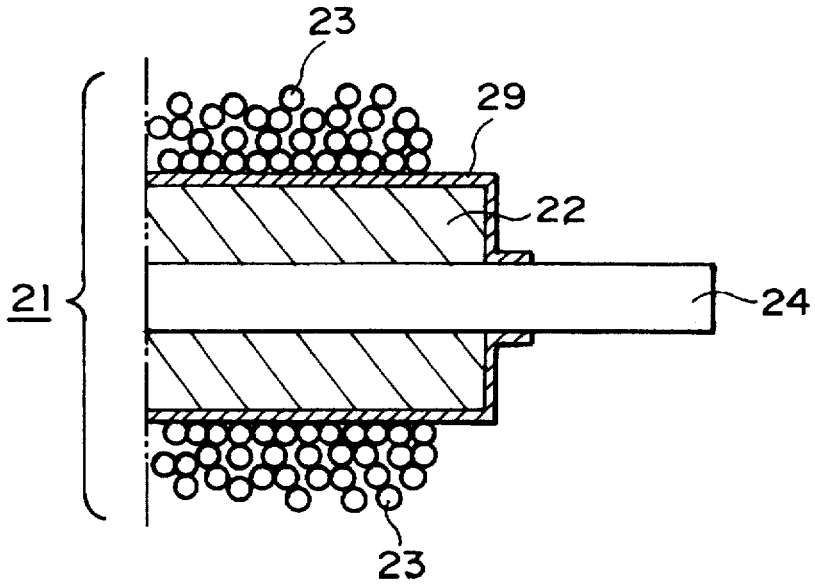
FIG. 8 is a schematic view of a section of an end portion of a magnet roller having a surface treated for electroconductivity using light curing electroconductive paint (third embodiment).

FIG. 8 shows a further embodiment of the charging member.

Also, in this embodiment, the surface of the magnet roller 22 is made conductive by the coating 29. As for the electroconductive paint (electroconductive coating material) for forming the electroconductive coating layer 29, light curing material is used.

If the paint applied to the magnet roller 22 surface as in the second embodiment, there is a liability that the magnetic force of the magnet is weakened if the paint is cured by heat. If the magnetic force is weakened, the magnetic confining force decreases.

In this embodiment, light curing material is used as the binder in the electroconductive paint. More particularly, as the binder resin material, light a curing acrylic is used, and 80% by weight of carbon graphite is dispersed as the electroconductive powder. Other usable binder materials include unsaturated polyester, eopxy acrylic, PVC plastisol or the like. As for the electroconductive material, carbon black, $SnO_2$, ITO, $TiO_2$ or another metal oxide are usable.

The electroconductive coating liquid is dip-coated on the magnet roller 22 surface, and it is cured by irradiation with ultraviolet radiation for 30 minutes. The thickness of the coating was approx. 20 microns, and resistance was approx. $5\times10^2$ Ohm.

Using the charging member 21 of the magnetic brush type, the photosensitive member 1 was charged, and the deposition of the deposition from the magnetic brush 23 to the photosensitive member 1 could be significantly reduced, thus permitting stabilized charging.

Thus, by changing the energy for the curing from the heat to the light, the reduction of the magnetic force due to heat can be avoided so that the the magnet roller surface could be made electroconductive while maintaining the magnetic confining force for the carrier.

EMBODIMENT 4

Figure 9:
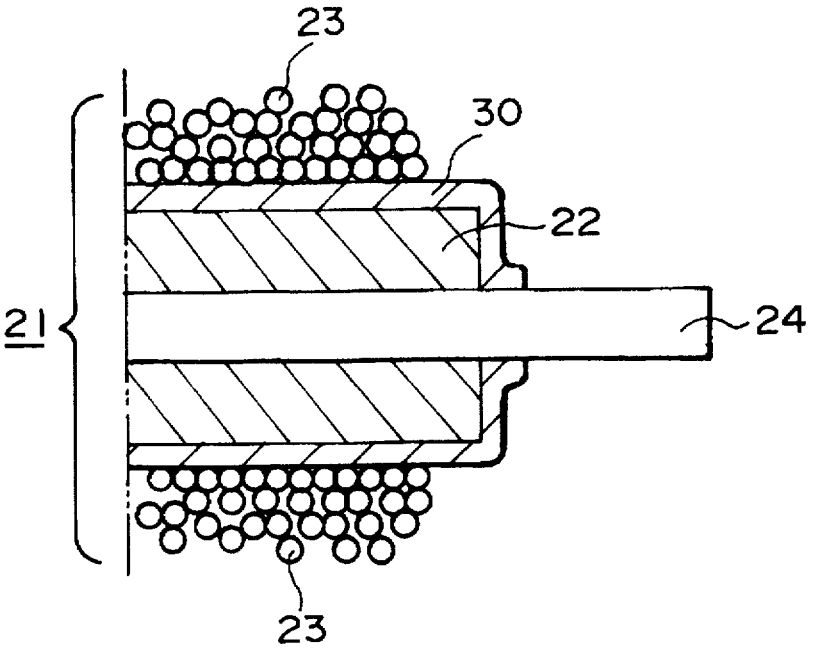
FIG. 9 is a schematic view of a section of an end portion of a magnet roller having a surface treated for electroconductivity by wrapping it with electroconductive tube (a fourth embodiment).

FIG. 9 shows another embodiment of the charging member.

In this embodiment, the magnet roller 22 is coated with an electroconductive rubber tube 30 by which the surface of the magnet roller 22 is made electrically conductive.

FIG. 8 show a magnetic brush charger used in this embodiment. The used rubber material was butyl rubber, and 50% by weight of carbon black is dispersed as the electroconductive particle. It is formed into a rubber tube 30 having a thickness of approx. 250 microns. The tube 30 had a resistance of approx. $10^3$ Ohm. By covering the magnet roller 22 with the rubber tube 30, the magnet roller 22 surface is made conductive.

When the electric energy is supplied from the charging bias voltage source S1 directly to the magnet roller surface, the photosensitive member 1 surface can be uniformly charged. In another method, conductive rubber tube 30 is supplied to the inside surface of a mold, and then, the magnet material is poured thereinto, and it is magnetized after molding. The same advantageous effects are provided.

With a method in which the magnet surface is made conductive by application of electroconductive paint as in the second or their embodiment, the electroconductive portion may be peeled off by rubbing with carrier with the result of loss of the conductivity. In the case of of structure in which the magnet roller 22 is covered with the conductive tube 30 as in this embodiment, the problem does not arise. Therefore, durability increases, and the stable electric energy supply is possible even if the magnetic brush type charging member 21 is used for a long term. Since the rubber tube 30 has an elasticity, an excessive voltage across the charging nip portion 27 (FIG. 1) can be eased, thus reducing the damage to the photosensitive member 1.

EMBODIMENT 5

Figure 10:
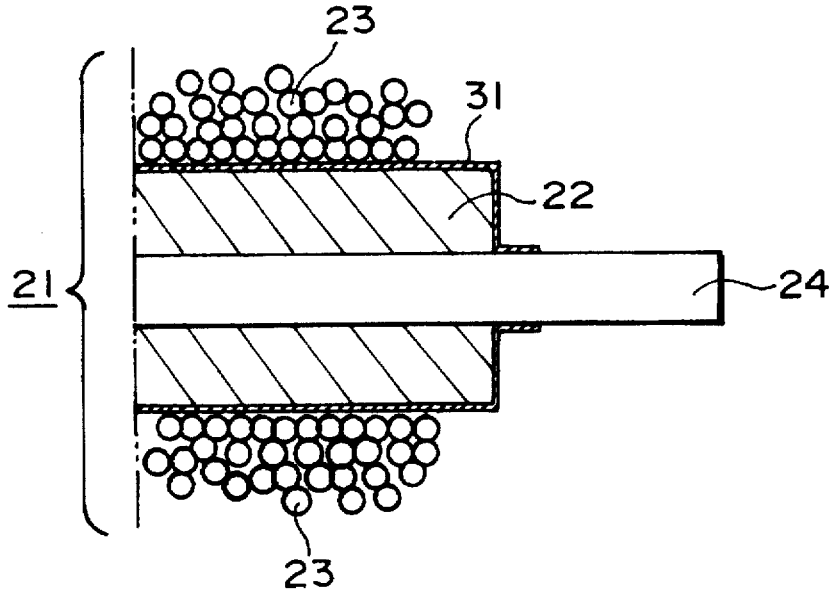
FIG. 10 is a schematic view of a section of an end portion of magnet roller having a surface treated for electroconductivity by formation of a metal layer thereon.
Figure 11:
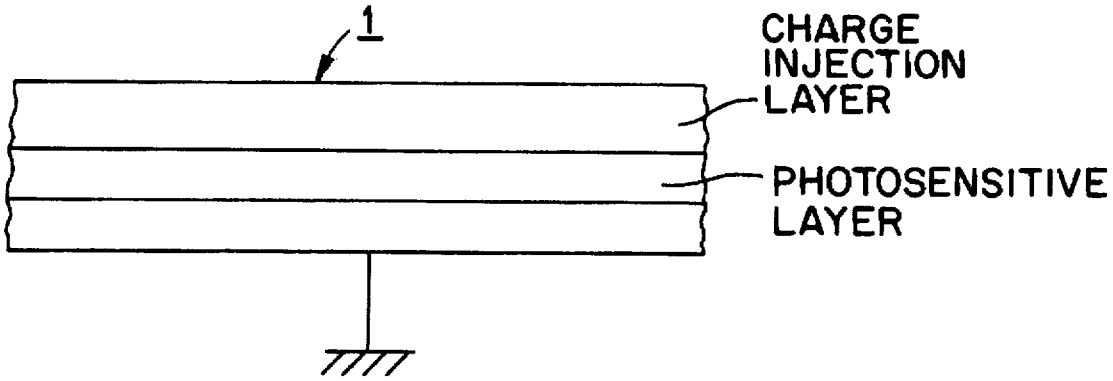
FIG. 11 shows the separate layers of the image bearing member.

FIG. 10 shows a further embodiment of the charging member.

In this embodiment, the surface of the magnet roller 22 is coated with a metal layer 31, so that the surface of the magnet roller 22 is made conductive.

Cu is applied through vacuum evaporation to the magnet roller 22 surface as metal electroconductive layer 31, while rotating the magnet roller 22, into a thickness of 10 microns. The usable metals include aluminum, gold, silver or the like.

The carrier is deposited to the magnet roller 22 to form a magnetic brush 23, and the charging is effected using it. The magnetic brush 23 is stably supplied with electric energy for a long period, and the photosensitive member 1 surface is uniformly charged.

By forming the metal electroconductive layer 31 on the magnet roller 22 surface as in this embodiment, there is no need of resistance adjustment by dispersion of electroconductive material in the magnet roller 22 surface as in the second or third embodiment, and the metal is usable. The manufacturing steps can be reduced, thus permitting manufacturing cost reduction. The conductivity can be given while maintaining smoothness of the magnet roller 22 surface.

In the foregoing each embodiment, a rotation magnet roller is used as the magnet member, but the magnet member may be a rotatable endless belt member, or may be a circular or polygonal rod, or an elongated plate, or the like.

All of the foregoing charging members are usable as a charging member of charge injection type or charging member of DC or AC type.

When the photosensitive member is provided with a charge injection layer, the resistance value of the charging member is $1\times10^4$–$1\times10^7$ Ohm, desirably.

When a low resistance charging member is used, an excessive leakage current flows from the charging member through damage such as a pin hole or the like on the photosensitive member drum (member to be charged) if any. Then, problem of charging defect around the drum pin hole, expansion of the pin hole or the electroconductive breakdown of the charging member may occur. To prevent this, the resistance value of the charging member is preferably not less than $1\times10^4$ Ohm approx. On the other hand, the if resistance value of the charging member is larger than $1\times10^7$ Ohm, the current required for the charging is not enough. The resistance value is preferably not more than $1\times10^7$ Ohm. The resistance value is calculated on the basis of the measurement of the current using an aluminum drum in place of the photosensitive member under the same condition as during the image forming operation in the other respects.

The volume resistivity rate of the charge injection layer is preferably $1\times10^{10}$–$1\times10^{15}$ Ohm.cm (100V application). The value is based on the measurement with a sheet-like sample of a charge injection layer using RESISTIVITY OF LL 16008A connected to HIGH RESISTANCE METER 4329A, available from YHP, Japan.

While the invention has been described with reference to the structures disclosed herein, it is not confined to the details set forth and this application is intended to cover such modifications or changes as may come within the purposes of the improvements or the scope of the following claims.

What is claimed is:

1. A charging member for charging a member to be charged, comprising:

a magnet member; and a surface electroconductive layer for supporting electroconductive magnetic particles, said layer being supported by said magnet member and rotating together with said magnet member in a region supporting said magnetic particles.

2. A member according to claim 1, wherein said electroconductive layer comprises a paint layer.

3. A member according to claim 2, wherein said electroconductive layer comprises a thermosetting material.

4. A member according to claim 2, wherein said electroconductive layer comprises a light curing material.

5. A member according to claim 1, wherein said electroconductive layer comprises an elastic tube.

6. A member according to claim 1, wherein said electroconductive layer is supplied with a voltage.

7. A member according to claim 1, wherein said charging member is provided with an electroconductive core member to which a voltage is applied.

8. A member according to claim 1, wherein said electroconductive layer is supported by said magnet member by means of a bonding material therebetween.

9. A member according to claim 1, wherein said magnet member is of roller shape.

10. A member according to claim 1, wherein said magnetic particle is contactable to said member to be charged.

11. A member according to claim 1, wherein said member to be charged comprises an image bearing member, and the image bearing member and said charging member are in a process cartridge detachably mountable to an image forming apparatus.

12. An image forming apparatus, comprising:

an image bearing member; and a charging member for charging said image bearing member, said charging member including a magnet member, electroconductive magnetic particles contactable to said image bearing member, and an electroconductive layer, on a surface of charging member, for supporting the magnetic particles, said electroconductive layer being supported by said magnet member and rotating together with said magnet member in a region supporting said magnetic particles.

13. An apparatus according to claim 12, wherein said image bearing member comprises a charge injection layer, and a charge is injected into said charge injection layer by contact between said magnetic particles and said charge injection layer.

14. An apparatus according to claim 13, wherein said charge injection layer has a volume resistivity rate of $1\times10^{10}$–$1\times10^{15}$ Ohm.cm.

15. A member according to claim 13 or 14, wherein said image bearing member is provided with an electrophotographic photosensitive layer inside of said charge injection layer.

16. An apparatus according to claim 12 or 13, wherein said charging member has a resistance value of $1\times10^{4}$–$1\times10^{7}$ Ohm.

17. An apparatus according to claim 12, wherein said electroconductive layer is a paint layer.

18. An apparatus according to claim 17, wherein said electroconductive layer comprises a light curing material.

19. An apparatus according to claim 12, wherein said electroconductive layer comprises a thermosetting material.

20. An apparatus according to claim 12, wherein said electroconductive layer comprises elastic tube.

21. An apparatus according to claim 12, wherein said electroconductive layer is supplied with a voltage.

22. An apparatus according to claim 12, wherein said charging member is provided with an electroconductive electroconductive core member to which voltage is applied.

23. An apparatus according to claim 12, wherein said electroconductive layer is supported by said magnet member by means of a bonding material therebetween.

24. An apparatus according to claim 12, wherein said magnet member is roller shaped.

* * * * *

UNITED STATES PATENT AND TRADEMARK OFFICE

CERTIFICATE OF CORRECTION

PATENT NO. : 5,666,192

DATED : Sept. 9, 1997

INVENTOR(S) : MASHIMO ET AL.

It is certified that error appears in the above-identified patent and that said Letters Patent is hereby corrected as shown below:

Column 4

Line 39, "FIG. 5, (a)," should read --FIG.5(a),--; and
Line 52, "FIG. 5(b)," should read --FIG. 5(b),--.

Column 5

Line 4, "is" should read --are--; and
Line 52, "(%)=(" should read ----(%) = ((--; and
Line 53, "speed (x 100." should read --speed) x100.--.

Column 7

Line 25, "light a" should read --a light--.

Column 8

Line 5, "their" should read --third--.

Column 6

Line 34, delete "as to"; and

Line 35, "material). The use is made with" should read --material) is made using--.

UNITED STATES PATENT AND TRADEMARK OFFICE

CERTIFICATE OF CORRECTION

PATENT NO. : 5,666,192

DATED : Sept. 9, 1997

INVENTOR(S) : MASHIMO ET AL.

It is certified that error appears in the above-identified patent and that said Letters Patent is hereby corrected as shown below:

Column 10

Line 37, "electroconductive" should be deleted.

Signed and Sealed this

Nineteenth Day of May, 1998

Bruce Lehman

*Attest:*

BRUCE LEHMAN

*Attesting Officer*

*Commissioner of Patents and Trademarks*